United States Patent [19]

Dehli

[11] 4,297,853

[45] Nov. 3, 1981

[54] RETRACTABLE HANDLE FOR AIR VALVE HEAT PUMP

[75] Inventor: Diane M. Dehli, Jeffersonville, Ind.

[73] Assignee: General Electric Company, Louisville, Ky.

[21] Appl. No.: 150,102

[22] Filed: May 15, 1980

[51] Int. Cl.[3] ..... F25B 29/00

[52] U.S. Cl. ..... 62/325

[58] Field of Search ..... 62/325, 140, 160

[56] References Cited

U.S. PATENT DOCUMENTS

| | | | |
|---|---|---|---|
| 2,391,151 | 12/1945 | Gibson | 62/325 |
| 2,401,560 | 6/1946 | Graham et al. | 62/325 |
| 2,466,383 | 4/1949 | Cody | 62/325 |
| 2,729,072 | 1/1956 | Dybvig | 62/325 |
| 2,878,657 | 3/1959 | Atchison | 62/325 |
| 2,899,802 | 8/1959 | McMillan | 62/157 |
| 2,911,797 | 11/1959 | Stocking | 62/176 |
| 2,970,816 | 2/1961 | McCarty | 62/325 |
| 2,975,611 | 3/1961 | Pietsch | 62/325 |
| 3,084,522 | 4/1963 | Hames, Jr. et al. | 62/325 |
| 3,143,864 | 8/1964 | Schordine | 62/325 |
| 3,995,446 | 12/1976 | Eubank | 62/325 |

*Primary Examiner*—Lloyd L. King

*Attorney, Agent, or Firm*—Frank P. Giacalone; Radford M. Reams

[57] ABSTRACT

The present invention relates to a heat pump that utilizes unidirection refrigerant wherein air directed across the condenser and evaporator is redirected for different operations. While the heat pump is operating in the cooling mode, manually operable dampers are positioned so that outdoor air is circulated through the condenser and indoor air is circulated through the evaporator. Conversely, in the heating mode, the dampers are manually positioned so that outdoor air is circulated through the evaporator; and indoor air is circulated through the condenser for heating the air.

3 Claims, 4 Drawing Figures

RETRACTABLE HANDLE FOR AIR VALVE HEAT PUMP

BACKGROUND OF THE INVENTION

This invention relates to air conditioners known as heat pumps: and, more particularly, to a reverse air cycle air conditioner that may be used for cooling or heating by redirecting air distribution.

There are two common types of heat pumps, or air conditioners that are used for heating as well as cooling. One type of heat pump reverses the refrigerant flow, thus the functions of the evaporator and condenser interchange. This type has disadvantages; including the use of a relatively expensive reversing valve, and other components necessary to allow the interchange of heat exchangers that may be costly to replace and maintain.

Another type of heat pump utilizes unidirection refrigerant flow wherein the condenser and evaporator retain their functions, but the air directed across them is redirected for different operations. While the heat pump is operating in the cooling mode, outdoor air is passed in heat exchange relationship with the condenser for liquifying the refrigerant and outside again; and indoor air is passed in heat exchange relationship with the evaporator for cooling the air circulated again. Conversely, in the heating mode, outdoor air passes in heat exchange relationship with the evaporator for vaporizing the refrigerant, then outside again; and indoor air is passed in heat exchange relationship with the condenser for heating the air and circulated again.

One prior art U.S. Pat. No., 2,878,657-Atchison, assigned to General Electric Company, the assignee of the present invention, discloses the latter type heat pump wherein the air conditioning unit includes a plurality of air controlling valves each of which is associated with an opposed inlet and outlet opening of the unit that permit selective control of the air flowing into and discharging from the unit in order to direct air either from the outside or from within the enclosure over either of the heat exchangers disposed within separate compartments of the unit.

Another prior art patent, U.S. Pat. No. 3,995,446, discloses a unit having a rotatable damper that can mutually and exclusively place the condenser and evaporator in the desired degree of communication with the outdoor or the indoor.

SUMMARY OF THE INVENTION

The present invention provides an air conditioning apparatus for conditioning air in an enclosure having a wall opening, and more particularly to an air conditioner including a housing adapted to be positioned in the wall opening with one side of said housing facing the outdoors and the opposite side of the housing facing said enclosure. A central chamber is defined by spaced partitions dividing the housing into an evaporator compartment and a condenser compartment. Arranged in the housing is a refrigerating system including a condenser in the condenser compartment, an evaporator in the evaporator compartment and a compressor in the central compartment. Positioned in each of the compartments is a fan shroud that substantially divides the evaporator and condenser compartments into inlet and outlet sections, each of the sections having an opening in both the indoor and outdoor facing side of the housing. A fan is positioned in each of the shrouds for circulating air through the evaporator and condenser compartments in a direction from the inlet section to the outlet section. Manually operable air valve means are provided for controlling the flow of air through the evaporator and condenser compartments for heating or cooling the enclosure. The air valve means include a first damper slidably arranged in the indoor facing side of the housing that is associated with the indoor facing openings of the compartments and a second interconnected damper slidably arranged in the outdoor facing side of the housing that is associated with the outdoor facing opening of the compartments. Hand operated retractable handles are provided adjacent the vertical edge of the indoor damper for moving the damper between compartment openings. The damper are selectively positioned to a first cooling position wherein the indoor facing openings of the evaporator compartment communicate with the enclosure and the outdoor facing openings of the condenser compartment communicate with the outdoors for cooling the air, and to a second heating position wherein the indoor facing openings in the condenser compartment communicate with the indoors for heating the air.

DESCRIPTION OF THE PREFERRED EMBODIMENT

Figure 1:
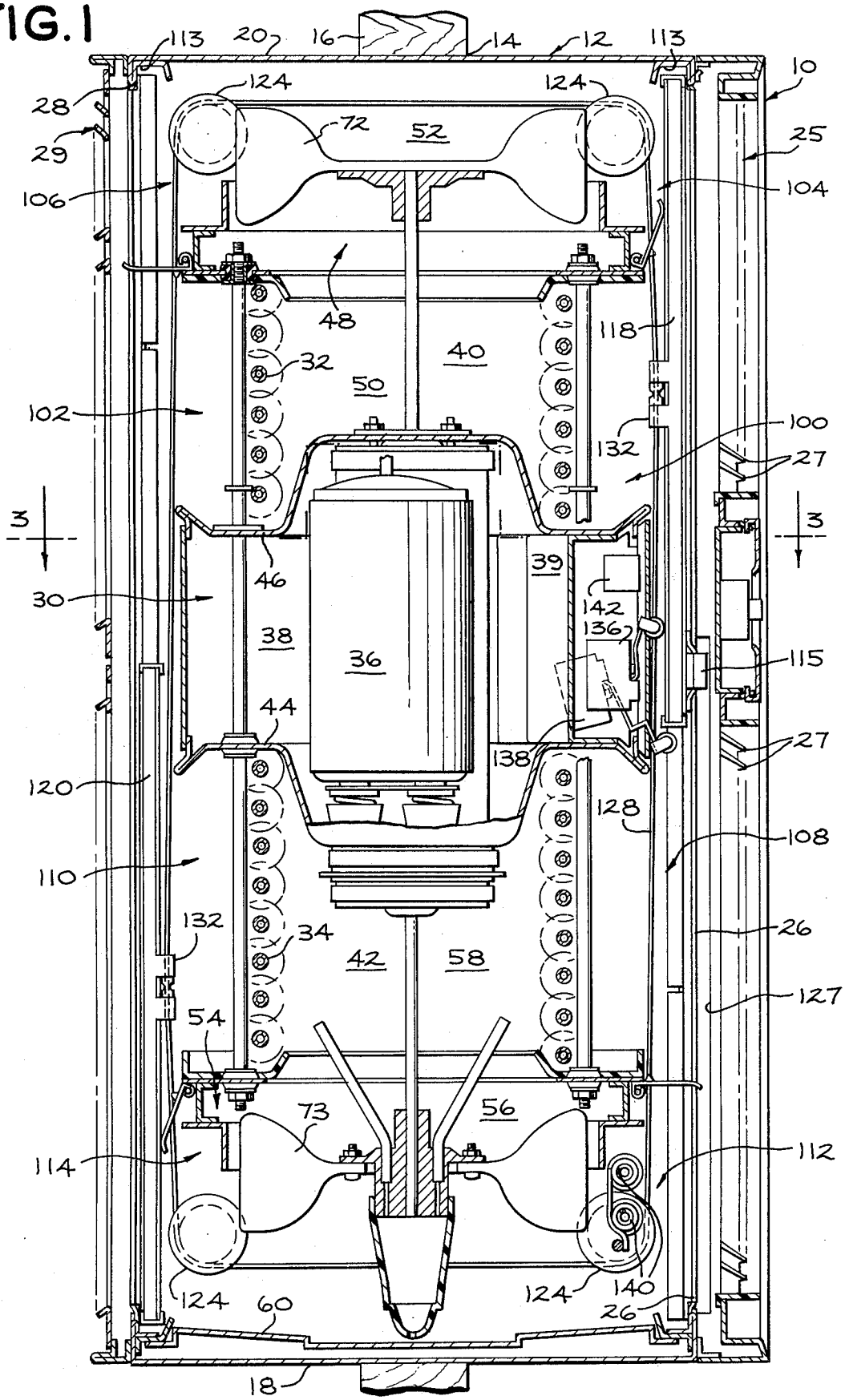
FIG. 1 is a side elevational view in section of the selfcontained air conditioning unit incorporating the present invention.

Referring now to the drawings and more particularly to FIG. 1, there is shown an air conditioner unit 10 including a housing 12 that is adapted to be arranged in an opening 14 in the wall 16 of an enclosure to be conditioned. The housing 12 is generally rectangular in shape (FIG. 2) and includes bottom and top walls 18 and 20 respectively interconnected by longer side walls 22 and 24. The housing walls (FIG. 1) define generally a front opening 26 disposed in the enclosure side of wall 16 and a rear opening 28 disposed in the outdoor side of wall 16. Arranged over the front opening 26 of housing 12 is a front grille or appearance member 25 which includes appropriate air deflecting vanes 27, while a grille 29 is positioned over the rear opening 28.

Figure 2:
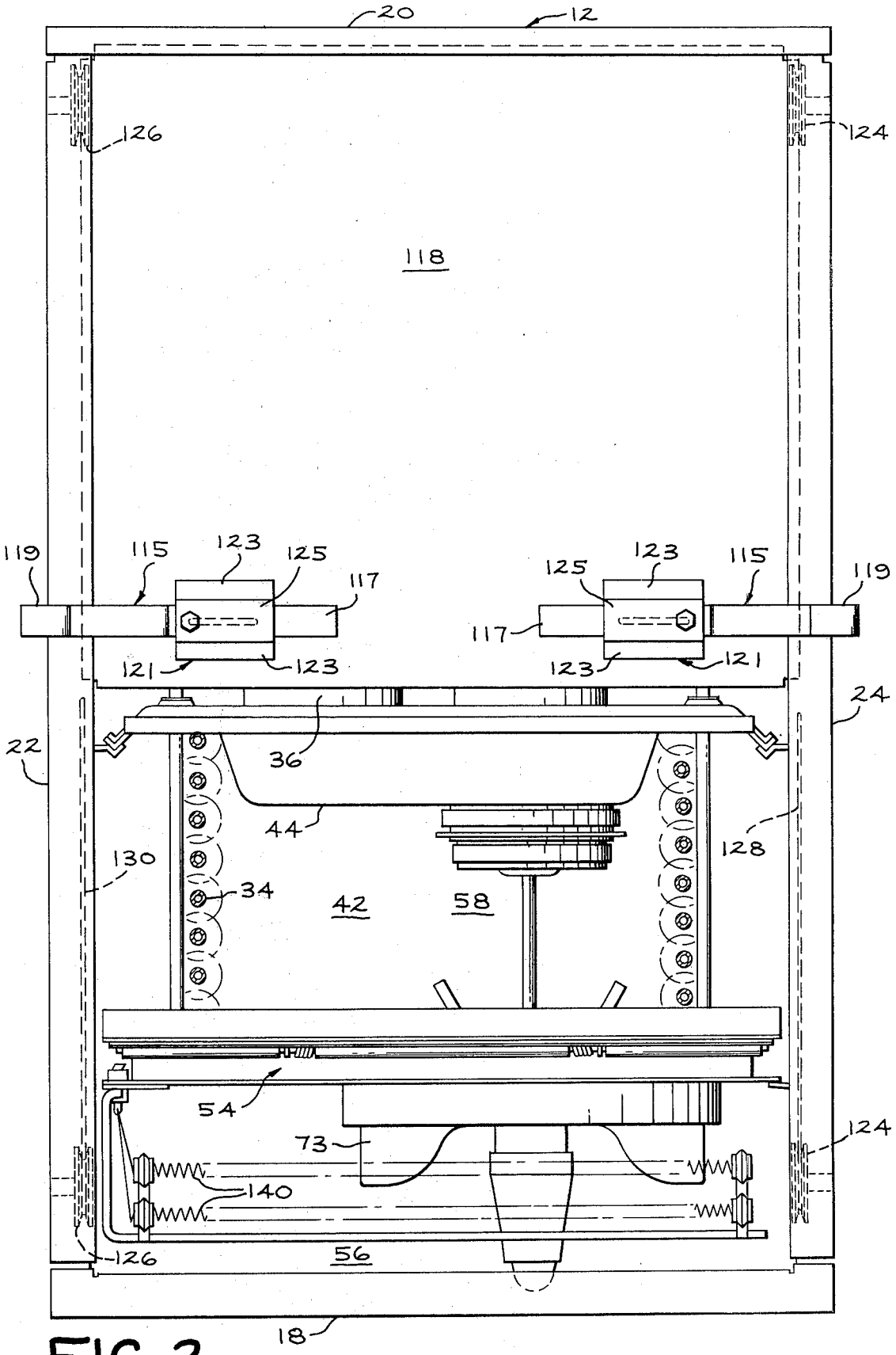
FIG. 2 is a front elevational view partially in section of the self-contained air conditioning unit incorporating the present invention.

Mounted within the housing 12 in a manner to be fully described hereinafter is a removably arranged chassis 30. Mounted on chassis 30, is the air conditioner refrigeration system including an evaporator 32 and a condenser 34 connected in refrigerant flow relationship with a compressor 36. Referring to FIGS. 1–2, it will be seen that the chassis 30 includes a plurality of parallel spaced partitions that divide the housing 12 to include a central or machine compartment 38, which houses the compressor 36 and a control box 39, an upper or evaporator compartment 40 and a lower or condenser compartment 42. The partitions of chassis 30 include two spaced substantially parallel central partitions 44 and 46 which define the central compartment 38. An upper fan shroud partition member 48 substantially divides the upper evaporator compartment 40 into an inlet area 50 defined by member 48 and partition 46 and an outlet area 52 defined by member 48 and the upper wall 20 of housing 12. The evaporator 32 is securely held between the partitions 46 and 48 in the inlet area 50. A lower fan shroud partition 54 substantially divides the lower condenser compartment 42 into an inlet area 58 defined by the member 54 and partition 44 and an outlet area 56 defined by member 54 and sump pan 60 arranged in the lower wall 18 of housing 12. The condenser 34 is securely held between the partitions 44 and 54 in the inlet area 58.

Air is circulated by a fan 72 arranged in shroud 48 from the evaporator inlet section 50 to evaporator outlet section 52 and similarly air is circulated by a fan 73 arranged in shroud 54 from the condenser inlet 58 to condenser outlet section 56.

Referring to FIG. 1, it can be seen that the inlet and outlet sections of the evaporator and condenser compartments are arranged within the rectangular housing 12 with each section having a pair of openings therein, one cummunicating with opening 28 facing the outdoors, and a second opening communicating with opening 26 facing the enclosure whereby air can be both introduced and discharged from the evaporator and condenser compartments in two different directions. More specifically, the evaporator compartment inlet section 50 contains openings 100 and 102 and the outlet section 52 contains openings 104 and 106 in the indoor and outdoor side respectively of housing 12. Similarly condenser compartment inlet section 58 is provided with openings 108 and 110, and the outlet section 56 is provided with opening 112 and 114 in the indoor and outdoor side respectively of housing 12. As will be hereinafter explained, the inlet and outlet openings of each compartment on the indoor and outdoor side of housing 12 is provided with means for selectively controlling the air flow through the condenser and evaporator compartments.

Figure 3:
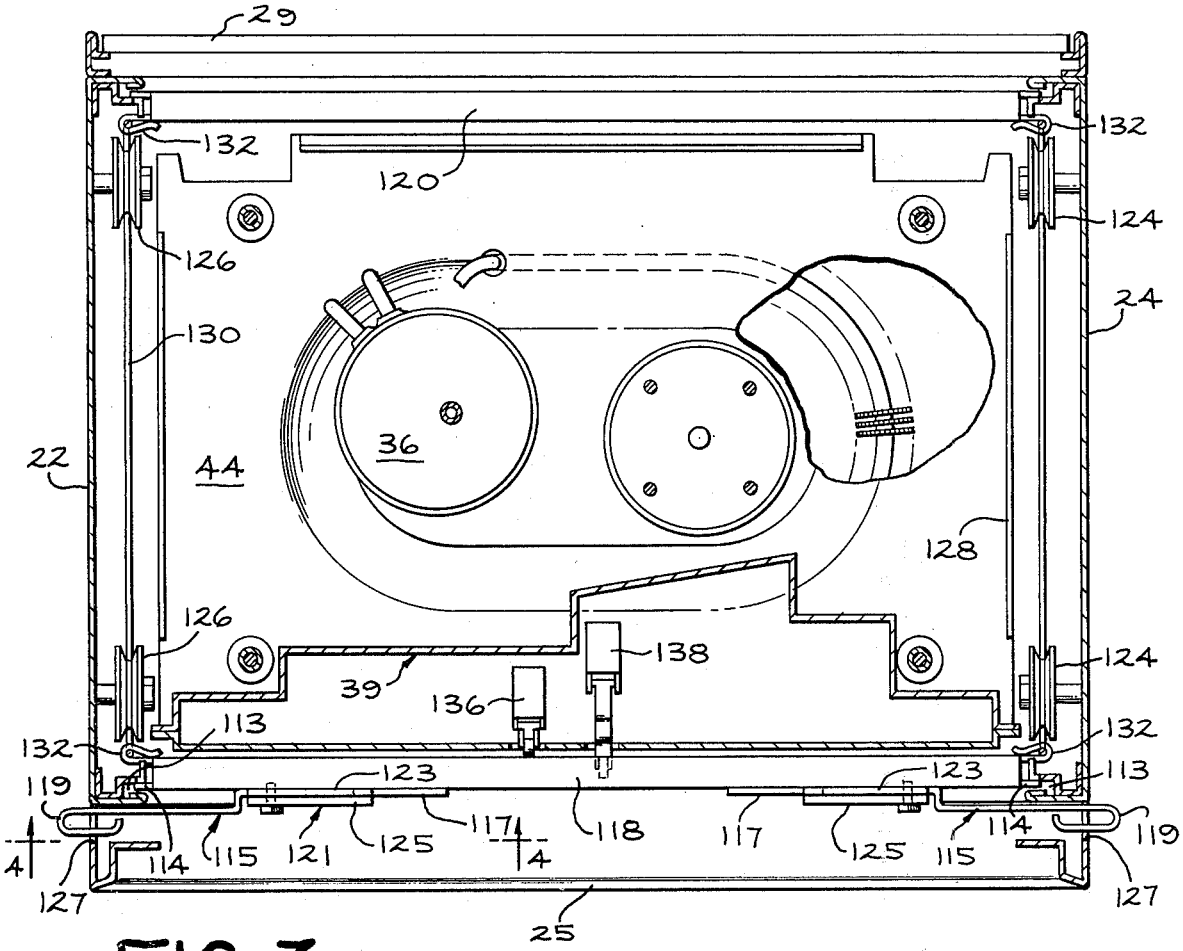
FIG. 3 is a sectional plan view taken along lines 3—3 of FIG. 1.
Figure 4:
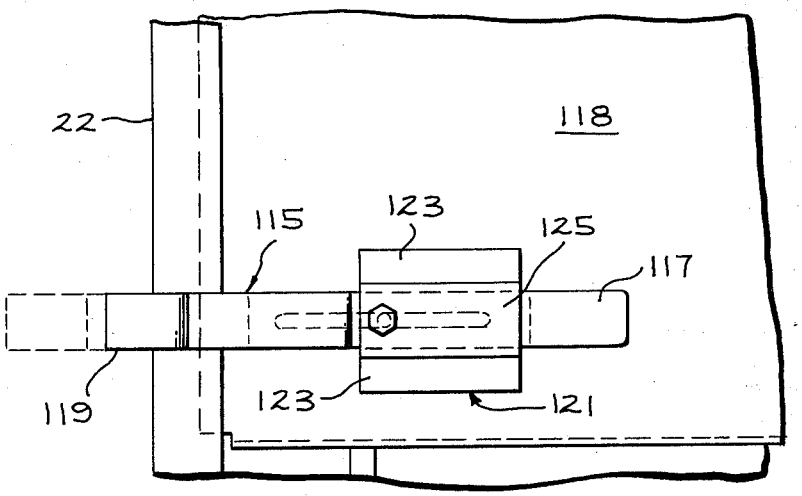
FIG. 4 is a partial front elevational view of the damper incorporating the present invention.

As may be seen in FIG. 1, the front openings 26 and 28 of housing 12 are provided with channel or track portions 113 that extend completely around the openings. Each opening 26 and 28 is provided with means for controlling air flow through the evaporator and condenser compartments. In the present embodiment, air flow is controlled by a pair of air valves or dampers 118 and 120 that are fitted for vertical movement in the track portions 116 on the openings 26 and 28 respectively. To this end, the dampers 118 and 120 are provided with guide portions 114 that extend outwardly from, and along substantially the entire vertical edges of each damper. The guides 114 are dimensioned to be received in the track 113 as shown in FIG. 3.

In the illustrated embodiment of the invention, the dampers are interconnected to insure proper location of one damper over a compartment inlet and outlet opening one one side of the housing by movement of the other damper arranged on the other side of the housing. To this end (FIG. 2), there is provided a first set of four rollers 124 rotatably mounted on the side wall 24 of housing 12 and a similar set of four rollers 126 rotatably mounted on the side wall 22 of housing 12. With reference to FIG. 1, it will be seen that the rollers are mounted near the corner portions of the side walls to, in effect, outline a rectangle on each side wall. Arranged on rollers 124 is an endless cable 128, while an endless cable 130 is arranged on the rollers 126. The front damper 118 is secured to each vertical pass of the cables 128, 130 at a point where they communicate with the front opening 26, while the back damper 120 is secured to the cables 128, 130 at a point where they communicate with the back opening 28. To this end, the dampers are provided with fastening members 132 located on the back or inner wall along the vertical edge of the dampers. With the dampers properly positioned relative to the compartment openings, the fastening members 132 are then crimped to the cables. Accordingly, vertical movement of the front damper 118 positioned in the enclosure side of housing 12 will cause an opposite vertical movement of the back damper 120 positioned in the outdoor side of the housing 12.

In use with the dampers 118, 120 arranged in the heating position shown in FIG. 1, the air flow through the conditioner 10 is such as to heat the air circulated from the enclosure. That is in the heating mode with the damper 118 closing the enclosure side inlet openings 100 and outlet opening 104 of evaporator compartment 40, air from the enclosure is drawn into the condenser compartment 42 through inlet 108 where it is passed through the condenser 34 heated and then back into the enclosure through outlet 112. In the heating mode, damper 120 closes the outside inlet openings 110 and outlet opening 114 of the condenser compartment 42 and air from the outdoors is drawn into the evaporator compartment through inlet 102 where it is passed through the evaporator 32 and back into the outdoors through outlet 106.

In the cooling mode the indoor damper 118 would be positioned over the enclosure side condenser inlet 108 and outlet 112 section openings so that enclosure air is drawn into the evaporator compartment through uncovered inlet 100 where it is passed through the evaporator and cooled and then back into the enclosure through outlet 104. In this mode the outdoor damper 120 would be positioned over the outdoor evaporator inlet 102 and outlet 106 openings so that outdoor air is drawn into the uncovered condenser compartment 42 through inlet 110 where it is passed through the condenser and then back into the outdoors through outlet 114.

Means are provided by the present invention to facilitate movement of the dampers by the user to either the heating or cooling position explained hereinabove. To this end, a pair of retractable handles 115 are arranged on the indoor damper 118. The handles 115 include a mounting portion 117 and a grip or handle portion 119. The mounting portion 117 of each handle is slidably arranged in a bracket or support member 121. The support members 121 are arranged on the outer wall adjacent the vertical edge portion 114 of damper 118 and includes flange portions 123 suitably secured to the front wall of damper 118 by any suitable means and a sleeve portion 125 spaced from the front wall of damper 118 to slidably receive portion 117 of handle 115. The handle portion 117 is positioned adjacent the front wall of housing 12 and extends through a cutout 127 formed in the side walls of the grille 25. The arrangement allows free vertical movement of the handle when the damper is moved between operative positions.

In their retracted position, as shown in FIG. 3, the handle portion 119 extends beyond the housing 12, a distance sufficient to allow the user to grip and pull out the handle 115 to its extended position shown in broken lines. Once in their extended position, the handles may be conviently used to move damper 118 to its selected position, through the above described interconnected cable system, which simultaneously positions the outdoor damper 120.

Control means are provided that prevent operation of the unit in the event the damper doors or air valves are not positioned properly relative to the selected inlet and outlet openings. To this end, there is mounted in the control box 39 a pair of switches 136 and 138. The switch 136 is a heater control switch through which a resistance heater 140 is energized. The switch 136 is moved to its control position when the damper 118 is in its up position and enclosure air is accordingly circulating through the condenser compartment 42. The switch 136 also orients the thermostat 142 so that it functions during the heating cycle between a lower ambient and a higher set temperature. The switch 138 is effective in locking out the heater 140 when the damper is in its down or cooling position and enclosure air is accordingly circulating through the evaporator compartment 40. Besides locking out the circuit to the heater 140, the switch 138 orients the thermostat 142 so that it functions during the cooling cycle between a higher ambient and lower set temperature. Another feature of the switch arrangement is to prevent operation of the air conditioner if both switches are closed. In effect, the switches are so arranged that the damper 118 must be either in its fully up heating position which means damper 120 is in its fully lowered position or in its down position, or cooling position which means damper 120 is in its fully up position.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. An air conditioning apparatus for conditioning air in an enclosure having a wall opening comprising:

a housing having openings on opposite sides thereof adapted to be positioned in said wall opening with the opening on one side of said housing facing the outdoors and the opening on the other side of said housing facing said enclosure;

a central chamber defined by spaced partition means dividing said housing into an upper evaporator compartment and a lower condenser compartment;

a refrigerating system including a condenser in said condenser compartment, an evaporator in said evaporator compartment and a compressor in said central chamber;

a fan shroud partition means in each of said compartments substantially dividing said compartments into inlet and outlet sections, each of said sections having an opening in both the indoor and outdoor facing side of said housing; a fan within each of said shrouds for circulating air through each of said compartments in a direction from said inlet section to said outlet section;

a first damper slidably arranged for vertical movement in the indoor facing side of said housing being associated with the indoor facing openings of said compartments; said damper is dimensioned to cover the openings of one of said compartments, a second damper slidably arranged for vertical movement in the outdoor facing side of said housing being associated with the outdoor facing opening of said compartments, said damper dimensioned to cover the opening of the other of said compartments;

retractable hand operable means on said indoor damper for moving said indoor damper to a selected one of said compartment openings damper connecting means associated with both of said dampers so that movement of said indoor damper arranged in the indoor facing openings to a position over one of said compartment openings causes movement of said outdoor damper on the outdoor facing openings to a position over the other of said compartment openings;

a handle having a mounting portion and a grip portion, a bracket member having flange portions secured to the outer wall of said indoor damper and a sleeve portion extending outwardly from said flange portion being spaced from said front wall of said indoor damper a distance sufficient to slidably receive the mounting portion of said handle so that said grip portion of said handle is slidable relative to said damper by a user of said apparatus a distance beyond the outer dimension of said housing side walls to an extended position for allowing said user to move said damper vertically through said connecting means over selected ones of their cooperating compartment openings.

2. The air conditioning apparatus recited in claim 1 wherein one of said handles is provided adjacent each vertical edge of said indoor damper.

3. The air conditioning apparatus recited in claim 2 further including a grille member mounted over the indoor facing opening of said housing and said handle portion is arranged to extend between said housing and said grille and being movable vertically in a recess formed in said grille.

* * * * *